US009896979B2

(12) United States Patent
Noonchester et al.

(10) Patent No.: US 9,896,979 B2
(45) Date of Patent: Feb. 20, 2018

(54) SYSTEM AND METHOD FOR CONTROLLING A TEMPERATURE OF OIL IN A POWER-PLANT OF A VEHICLE

(75) Inventors: Joseph J. Noonchester, New Hudson, MI (US); Jonathan Pung, Auburn Hills, MI (US); Thomas A. Spix, Rochester Hills, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 2060 days.

(21) Appl. No.: 13/032,870

(22) Filed: Feb. 23, 2011

(65) Prior Publication Data

US 2012/0211216 A1 Aug. 23, 2012

(51) Int. Cl.

| | |
|---|---|
| ***G05D 23/13*** | (2006.01) |
| ***F01P 11/08*** | (2006.01) |
| ***F01M 5/00*** | (2006.01) |
| ***F01M 5/02*** | (2006.01) |

(52) U.S. Cl.
CPC ..... *F01M 5/021* (2013.01); *F01M 5/007* (2013.01)

(58) Field of Classification Search
CPC ..... F01M 5/007
USPC ..... 236/12.1
See application file for complete search history.

(56) References Cited

U.S. PATENT DOCUMENTS

| | | | | |
|---|---|---|---|---|
| 4,883,082 | A * | 11/1989 | Pirkle | 137/62 |
| 5,921,829 | A | 7/1999 | Iwata | |
| 5,960,872 | A * | 10/1999 | Huemer et al. | 165/298 |
| 6,016,774 | A | 1/2000 | Bokkers et al. | |
| 6,053,131 | A | 4/2000 | Mueller et al. | |
| 6,427,640 | B1 * | 8/2002 | Hickey et al. | 123/41.31 |
| 6,506,211 | B1 | 1/2003 | Asano | |
| 6,938,605 | B2 * | 9/2005 | Al-Khateeb | 123/196 AB |
| 6,942,023 | B2 * | 9/2005 | Fang et al. | 165/140 |
| 7,216,697 | B2 | 5/2007 | Odeskog et al. | |
| 2002/0148433 | A1 * | 10/2002 | Rossiter | 123/196 AB |
| 2005/0039719 | A1 * | 2/2005 | Moss | 123/196 AB |
| 2005/0150470 | A1 * | 7/2005 | Al-Khateeb | 123/41.33 |
| 2005/0161519 | A1 * | 7/2005 | Kalbacher et al. | 236/34.5 |
| 2005/0199210 | A1 * | 9/2005 | Biess et al. | 123/179.19 |

(Continued)

FOREIGN PATENT DOCUMENTS

| | | | |
|---|---|---|---|
| DE | 102008032496 | A1 | 1/2010 |
| EP | 1653062 | A1 | 5/2006 |

(Continued)

*Primary Examiner* — Henry Crenshaw
(74) *Attorney, Agent, or Firm* — Quinn IP Law

(57) ABSTRACT

A system is provided for controlling a temperature of oil in a power-plant operable to propel a vehicle. The system includes a heat-exchanger arranged relative to the power-plant. The heat-exchanger is configured to receive the oil from the power-plant, modify the temperature of the oil, and return the modified temperature oil to the power-plant. The system also includes a valve configured to direct the oil through the heat-exchanger during a warm-up operation of the power-plant such that the temperature of the oil is increased. The valve is also configured to direct the oil to bypass the heat-exchanger during a low load operation of the power-plant such that the temperature of the oil is increased. Additionally, the valve is configured to direct the oil through the heat-exchanger during a high load operation of the power-plant such that the temperature of the oil is decreased.

17 Claims, 5 Drawing Sheets

(56) References Cited

U.S. PATENT DOCUMENTS

| | | | | |
|---|---|---|---|---|
| 2006/0016900 | A1* | 1/2006 | Brown et al. | 236/34.5 |
| 2006/0065230 | A1* | 3/2006 | Hoi | 123/196 AB |
| 2008/0006229 | A1* | 1/2008 | Wilmink et al. | 123/41.33 |
| 2008/0295785 | A1* | 12/2008 | Harris et al. | 123/41.08 |
| 2009/0229812 | A1* | 9/2009 | Pineo et al. | 165/297 |
| 2011/0005741 | A1* | 1/2011 | Sheppard | 165/297 |

FOREIGN PATENT DOCUMENTS

| | | | |
|---|---|---|---|
| GB | 1014481 | A | 12/1965 |
| GB | 2018977 | A | 10/1979 |
| JP | 4259125 | B2 | 4/2009 |
| KR | 20010059164 | A | 7/2001 |

* cited by examiner

SYSTEM AND METHOD FOR CONTROLLING A TEMPERATURE OF OIL IN A POWER-PLANT OF A VEHICLE

TECHNICAL FIELD

The present invention relates to a system and a method for controlling a temperature of oil in a power-plant of a vehicle.

BACKGROUND

As a by-product of generating power for propelling a motor vehicle, the vehicle's power-plant, such as an internal combustion engine, typically generates heat energy. Accordingly, after the power-plant is activated, it proceeds through a "warm-up" period during which the temperature of the power-plant is increased from an ambient temperature. Generally, following the warm-up period, the power-plant is cooled in order to maintain its operating temperature in a particular range and ensure the power-plant's efficient and reliable performance.

In a majority of motor vehicles, power-plants are cooled by a circulating fluid, such as a specially formulated chemical compound mixed with water. Additionally, vehicle power-plants are lubricated and cooled by oils that are generally derived from petroleum-based and non-petroleum synthesized chemical compounds. Such oils mainly use base oils composed of hydrocarbons that are blended with chemical additives to minimize a power-plant's internal friction and wear.

SUMMARY

A system is provided for controlling a temperature of oil in a power-plant operable to propel a vehicle. The system includes a heat-exchanger arranged relative to the power-plant. The heat-exchanger is configured to receive the oil from the power-plant, modify the temperature of the oil, and return the modified temperature oil to the power-plant. The system also includes a valve configured to direct the oil through the heat-exchanger during a warm-up operation of the power-plant such that the temperature of the oil is increased. The valve is also configured to direct the oil to bypass the heat-exchanger during a low load operation of the power-plant such that the temperature of the oil is increased. Additionally, the valve is configured to direct the oil through the heat-exchanger during a high load operation of the power-plant such that the temperature of the oil is decreased.

The valve may be additionally configured to direct the oil to bypass the heat-exchanger during a low ambient temperature start of the power-plant such that the temperature of the oil is not modified by the heat-exchanger.

The system may also include an actuator configured to operate the valve. The system may additionally include a spring configured to bias or load the valve against the actuator. The actuator may be one of a wax motor and a solenoid. The wax motor may be configured as a two-stage wax motor. Furthermore, the system may include a controller in electrical communication with the actuator. In such a case, the controller is configured to regulate the actuator according to one of the warm-up, low load, and high load operation of the power-plant.

Moreover, the system may additionally include a fluid pump configured to circulate a coolant through the heat-exchanger for modifying the temperature of the oil.

The power-plant may be an internal combustion engine.

A method of controlling a temperature of oil in a vehicle power-plant is also provided.

The above features and advantages and other features and advantages of the present invention are readily apparent from the following detailed description of the best modes for carrying out the invention when taken in connection with the accompanying drawings.

DETAILED DESCRIPTION

Figure 1:
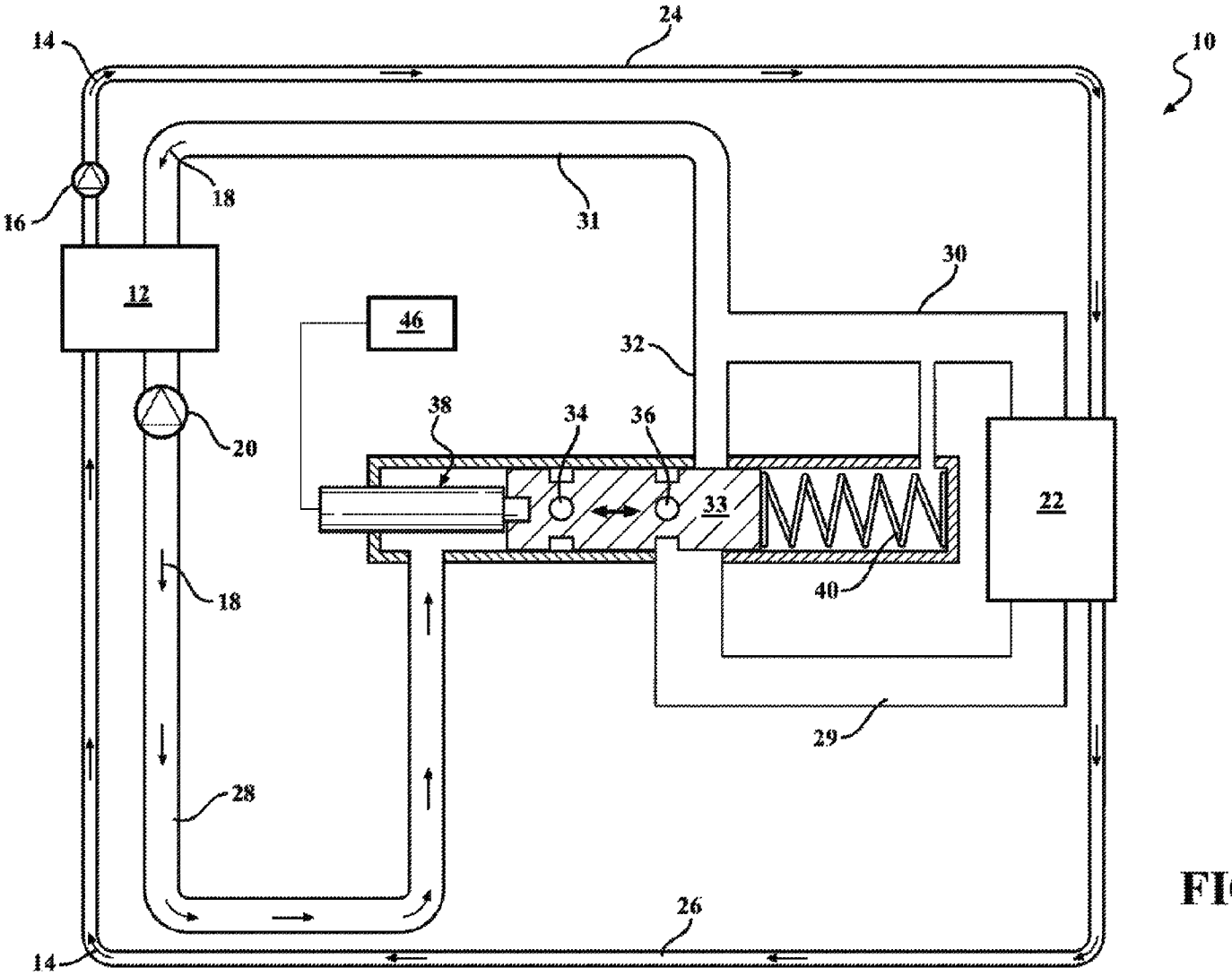
FIG. 1 is a schematic diagrammatic view of a vehicle system employing one type of an actuator and configured to control temperature of oil in a power-plant.

Referring to the drawings, wherein like reference numbers refer to like components, FIGS. 1-6 show a system 10 adapted for controlling a temperature of oil in a power-plant 12 of a motor vehicle. The power-plant 12 may be an internal combustion (IC) engine, such as a spark ignition or a compression ignition engine, a fuel cell, or an electric motor operable to propel the vehicle. As such, the subject vehicle may be a conventional, a hybrid, or an electric type.

The power-plant 12 produces heat energy as a by-product of generating power used to propel the vehicle. Such heat energy is removed by a circulating heat transfer fluid or coolant 14, continuously cycling through multiple coolant conduits of the system 10 via a fluid or coolant pump 16. The contemplated coolant is typically a solution of a suitable organic chemical (most often ethylene glycol, diethylene glycol, or propylene glycol) in water. The power-plant 12 is additionally cooled and lubricated by a body of oil 18. The oil 18 is continuously circulated through multiple oil conduits of the system 10 and through specifically configured channels and lubrication ports (not shown) arranged inside the power-plant 12 via an oil pump 20. The contemplated oil is generally derived from a petroleum or a non-petroleum based chemical compound synthesized to minimize the power-plant's internal friction and wear.

The system 10 also includes a heat-exchanger 22 in fluid communication with the power-plant 12. The heat-exchanger 22 is arranged relative to the power-plant 12, and is configured to receive the oil 18 from the power-plant, modify the temperature of the oil, and return the modified temperature oil to the power-plant. As shown in FIG. 1, the heat-exchanger 22 is contemplated as a coolant-to-oil radiator. The heat-exchanger 22 transfers heat energy between the coolant 14 and the oil 18, depending on the relative temperatures of the bodies of coolant and oil. Accordingly, when the oil temperature is greater than that of the coolant, the heat-exchanger 22 employs the coolant 14 for absorbing heat energy from the oil 18 to thus cool the oil. Additionally, when the coolant temperature is greater than that of the oil, the heat-exchanger 22 employs the coolant 14 for transferring the heat energy to the oil 18 to thus heat the oil. The fluid pump 16 is, therefore, configured to circulate the coolant 14 through the heat-exchanger 22 in order to modify the temperature of the oil 18.

The coolant 14 is delivered to the heat-exchanger 22 via a conduit 24 and exits the heat-exchanger via conduit 26. The oil 18 is delivered to the heat-exchanger 22 via a conduit 29. After the temperature of the oil 18 has been modified inside the heat-exchanger 22, the oil exits the heat-exchanger via conduit 30 and proceeds via a conduit 31 back to the power-plant 12. A conduit 32 is arranged between the conduit 28 and the conduit 31 to permit the oil to bypass the heat-exchanger 22 on demand. The system 10 also includes a spool valve 33. The valve 33 includes an inner hollow (not shown) that is in fluid communication with the oil 18 and is also connected to the exterior surface of the valve via cross-drill or the like passages represented by apertures 34 and 36. The valve 33 is shuttled back and forth inside the conduit 28 for selectively controlling the flow of oil 18 through the heat-exchanger 22. The valve 33 is configured to direct the oil 18 through the heat-exchanger 22 during warm-up and during high load operation of the power-plant 12. The valve 33 is also configured to block off access of the oil 18 to the conduit 29 to thereby bypass the heat-exchanger 22 during low load operation of the power-plant 12.

The system 10 is configured such that directing the oil 18 through the heat-exchanger 22 during the warm-up operation of the power-plant 12 via the valve 33 acts to increase the temperature of the oil when the temperature of the coolant 14 is relatively higher than that of the oil. Additionally, directing the oil through the heat-exchanger 22 during the high load operation of the power-plant 12 via the valve 33 acts to reduce the temperature of the oil when the temperature of the coolant 14 is relatively lower than that of the oil. Furthermore, directing the oil 18 to bypass the heat-exchanger 22 during the low load operation of the power-plant 12 acts to increase the temperature of the oil above that of the coolant 14.

The system 10 also includes an actuator 38 and a spring 40. The spring 40 is configured in a spring set position to bias the valve 33 against the actuator 38. The spring 40 is sized to overcome a set or predetermined difference in pressure of the oil 18 between the conduits 28 and 32. The actuator 38 is configured to operate the valve 33 by displacing the valve in the direction of compressing the spring 40 during cold start conditions and subsequent warm-up operation of the power-plant 12. The actuator 38 may be configured as an externally regulated magnetic solenoid (as shown in FIG. 1) or as a wax motor (as shown in FIGS. 2-6). As shown in each of FIGS. 1-6, the controller 46 is in electrical communication with the actuator 38. The controller 46 is configured, i.e., programmed, to regulate the actuator according to one of the warm-up, low load, and high load operation of the power-plant 12. The defining temperature and pressure parameters of the coolant 14 and the oil 18 for each of the warm-up, low load, and high load operation of the power-plant 12 may be established empirically during testing and development of the power-plant and the subject vehicle.

In the case that the actuator 38 is a wax motor, as illustrated by FIGS. 2-6, the wax motor functions as a linear actuator that is capable of providing an appropriately short range of linear motion via a plunger. Generally, the wax motor has three principal components, a block of wax, a plunger that bears on the wax, and an electric heater that heats the wax (not shown). The electric heater may be a positive temperature coefficient (PTC) thermistor, which, as known by those skilled in the art, is a type of an electronic component that is characterized by resistance that varies significantly with temperature. The wax motor operates when the electric heater is energized through the application of an electric current to heat the wax block. When the wax block is thus heated, the wax block will expand to drive the plunger to thereby displace the valve 33. When the electric current is removed, the wax block will cool down and contract to thereby cause the plunger to be pushed in or withdrawn with the assist from the force of the spring 40. The wax motor may additionally employ an internal spring (not shown) incorporated directly into the wax motor configured to assist the spring 40 in withdrawing the plunger.

Figure 3:
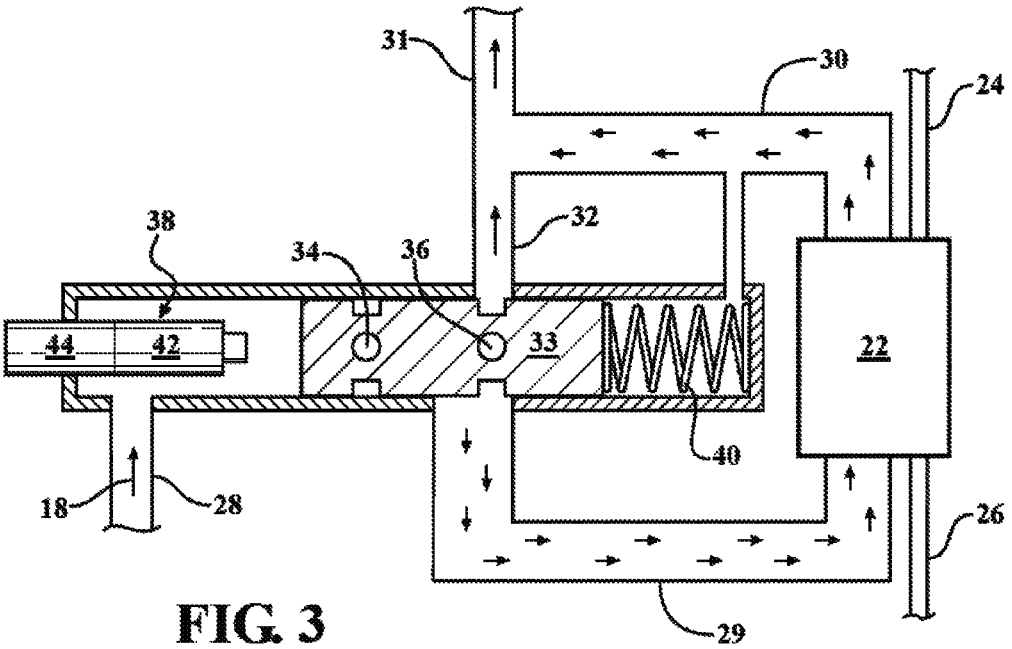
FIG. 3 is a schematic diagrammatic view of the vehicle system shown in FIG. 2, illustrating the power-plant during a subsequent warm-up operation.
Figure 4:
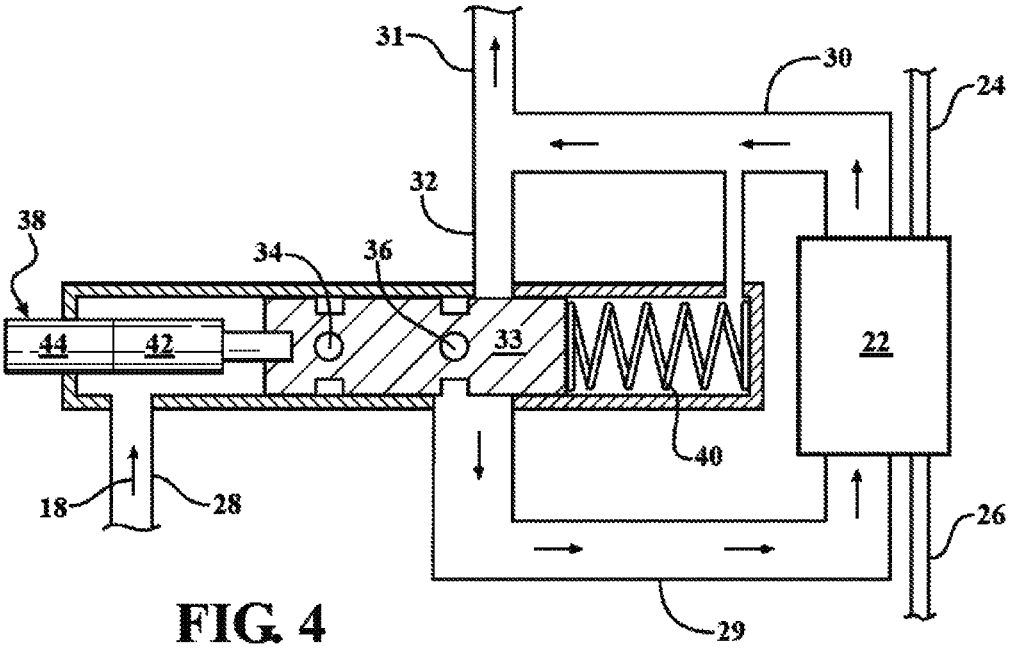
FIG. 4 is a schematic diagrammatic view of the vehicle system shown in FIG. 2, illustrating the power-plant during continued warm-up operation.
Figure 5:
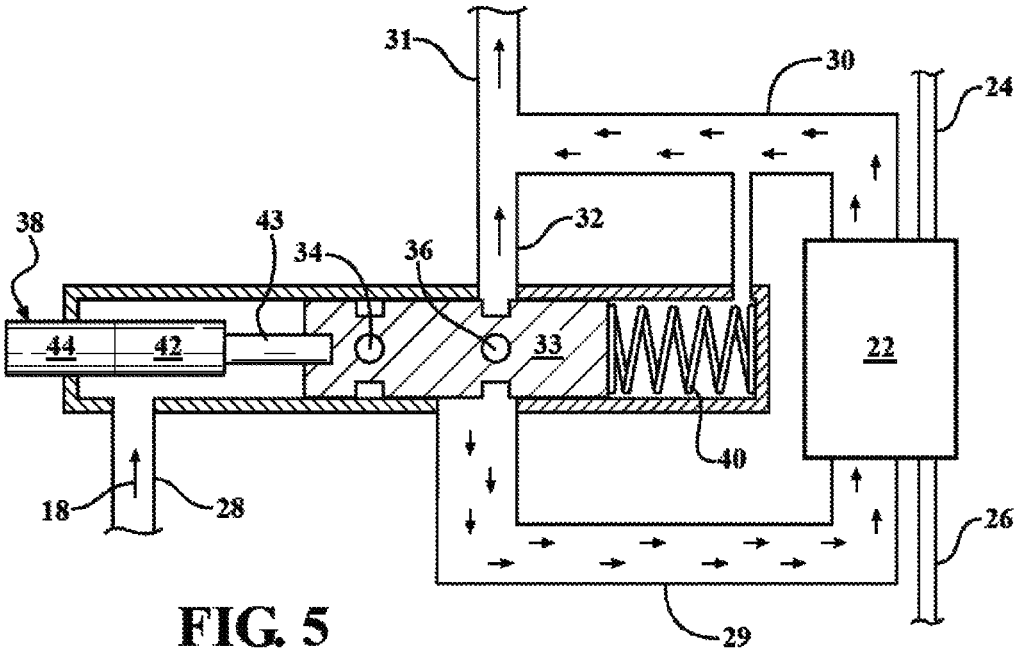
FIG. 5 is a schematic diagrammatic view of the vehicle system shown in FIG. 2, illustrating the power-plant during a low load operation.
Figure 6:
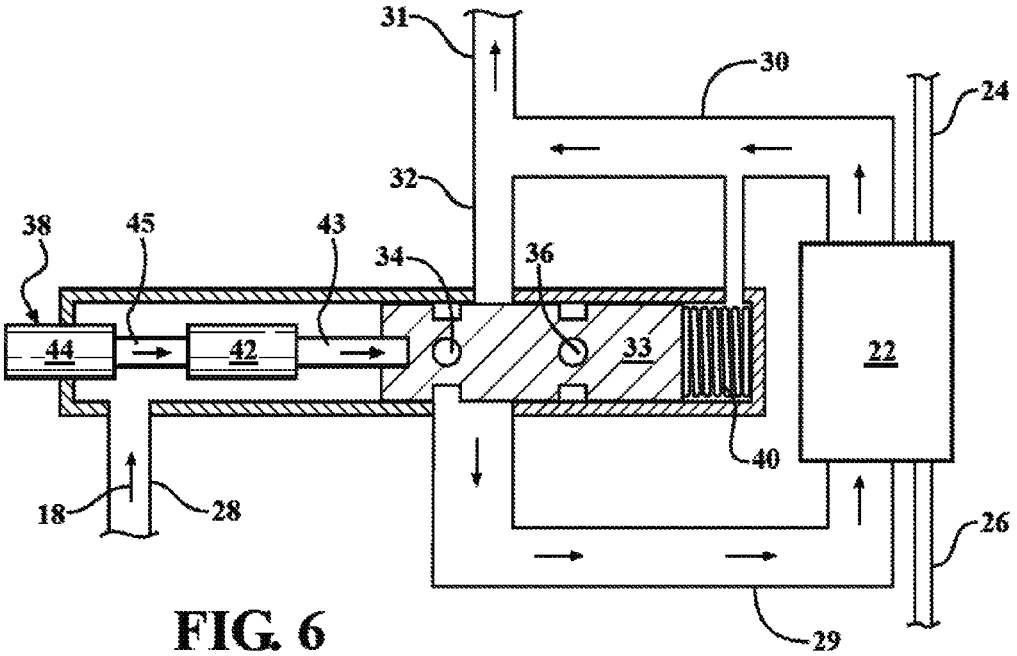
FIG. 6 is a schematic diagrammatic view of the vehicle system shown in FIG. 2, illustrating the power-plant during a high load operation.

As shown in FIGS. 2-6, the actuator 38 may also be configured as a two-stage wax motor where essentially two wax motors, each having a plunger, are arranged in series. In the case of the two-stage wax motor, a first wax motor 42 may be configured to be activated by the controller 46 at a first predetermined temperature of the oil 18 to displace the valve 33 via a plunger 43, thereby exposing the aperture 36 to the conduit 32 and permitting the oil to bypass the heat-exchanger 22 (as shown in FIG. 5). A second wax motor 44 may be activated by the controller 46 at a second predetermined temperature of the oil 18 to displace both the first wax motor and the valve 33 via a plunger 45 further toward the spring 40, thereby exposing the aperture 34 to the conduit 29 and permitting the oil to flow to the heat-exchanger 22 (as shown in FIG. 6). The first and the second predetermined temperatures at which the respective first and second wax motors 42, 44 are configured to be activated may be established empirically during testing and development of the power-plant 12 and the subject vehicle. Although FIGS. 2-6 illustrate the controller 46 being employed to control the wax motors 42, 44, the wax motors may also be configured to react directly to the temperature of the fluid flowing through the conduit 28 without any other external regulation.

Figure 2:
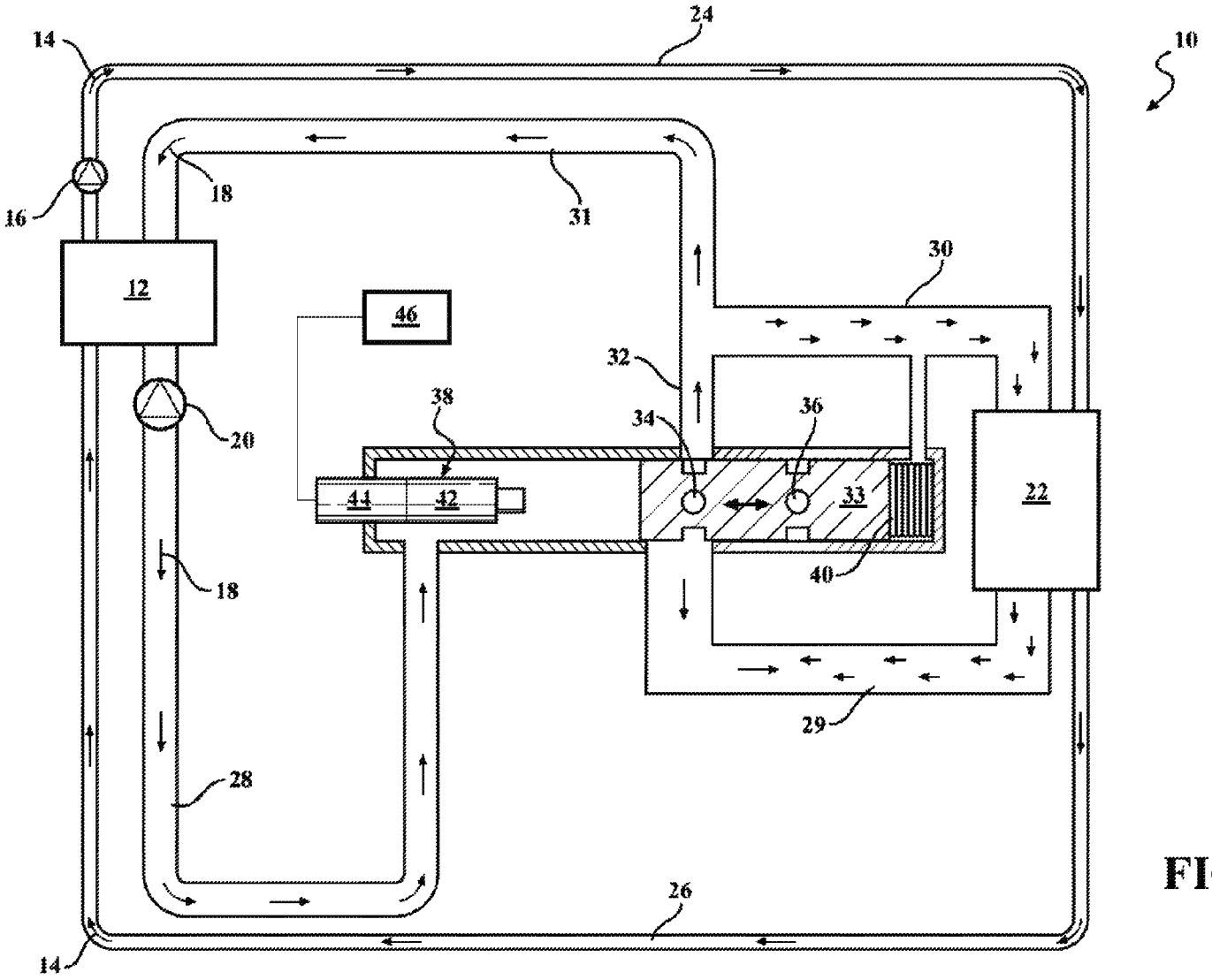
FIG. 2 is a schematic diagrammatic view of the vehicle system employing an alternate type of an actuator, illustrating a power-plant during a cold start operation.

Following is a detailed description of operation of the system 10 in connection with various operating modes of the power-plant 12 shown in FIGS. 2-6. A cold start of the power-plant 12 is shown in FIG. 2, where the temperatures of both the coolant 14 and the oil 18 are at an ambient temperature that is significantly below zero Celsius. During such a cold start of the power-plant 12 the pressure of the oil 18 in the conduit 28 is significantly higher than the pressure in conduit 31. As a result, the pressure of the oil 18 is sufficient to displace the valve 33 away from the actuator 38 to fully compress the spring 40 and expose the aperture 34 to the conduit 32. Additionally, an internal restriction through the heat-exchanger 22 is sufficient to generate a significant difference in oil pressure between the conduit 29 and the conduit 32 and force the majority of the oil 18 to bypass the heat-exchanger. Accordingly, during the low ambient temperature start of the power-plant 12 the valve 33 directs the oil 18 to bypass the heat-exchanger 22, such that the temperature of the oil is not modified by the heat-exchanger, and is therefore permitted to increase independently of the temperature of the coolant 14.

FIG. 3 illustrates continued operation of the power-plant 12 and the gradual warming up of the oil 18. As the oil 18 warms up, the pressure of the oil 18 in the conduit 28 decreases, as does the internal restriction through the heat-exchanger 22, which causes the valve 33 to be displaced back toward the actuator 38 in response to the force of the spring 40. As the valve 33 is displaced by the spring 40 during the gradual warm up of the power-plant 12, the aperture 36 becomes exposed to the conduit 32. Such a change in the difference between oil pressure in the conduits 28 and 31 permits a gradually increasing portion of the oil 18 to go through the heat-exchanger 22 to be heated by the coolant 14, while the remaining portion of the oil will still flow through the conduit 32. Thus, during the gradual warming up of the oil 18, as shown in FIG. 3, the heat-exchanger 22 performs as an oil heater.

As shown in FIG. 4, when the oil 18 continues to warm up, the difference in pressure between the conduits 28 and 31 will decrease below a threshold value, thus permitting the spring 40 to overcome the pressure difference and displace the valve 33 fully toward the actuator 38. The threshold value of the difference in pressure of the oil 18 may be established empirically during testing and development of the power-plant 12 and the subject vehicle. For example, the threshold value of the difference in pressure of the oil 18 between the conduits 28 and 31 at which the valve 33 can be fully displaced may be set at 150 KPa, which typically occurs around zero degrees Celsius. At such a point, the valve 33 will be fully closed, thereby directing substantially all the flow of the oil 18 through the heat-exchanger 22 to be heated by the coolant 14 and permitting the heat-exchanger to continue performing as an oil heater.

As substantially all the oil 18 begins to flow through the heat-exchanger 22, and the power-plant 12 continues to warm up, the temperature of the oil 18 will increase further. As the power-plant 12 continues to warm-up, each of the temperatures of the coolant 14 and the oil 18 will eventually reach the first predetermined temperature. The first predetermined temperature may be set at an equilibrium point where the temperatures of the coolant 14 and the oil 18 are substantially at par. Such an equilibrium point has been established to occur around 80 degrees Celsius for some applications of an IC engine operating at road load in a motor vehicle.

FIG. 5 illustrates the power-plant 12 in a substantially warm or steady-state operating state where the temperatures of the coolant 14 and of the oil 18 have reached the first predetermined temperature, for example 80 degrees Celsius. Such a steady-state operating state of the power-plant 12 will typically occur when the host vehicle is subjected to a relatively low road load, such as cruising at highway speeds. As shown in FIG. 5, after the temperature of the oil 18 reaches the first predetermined temperature, the first wax motor 42 of the actuator 38 will be activated by the controller 46 to displace the valve 33 via the plunger 43. Such displacement of the valve 33 will expose the aperture 36 to the conduit 32 and permit the oil 18 to bypass the heat-exchanger 22, thus permitting the temperature of the oil to increase above the temperature of the coolant 14.

FIG. 6 illustrates the power-plant 12 operating as an increased load. During high load operation of the power-plant 12, such as at higher vehicle speeds, when the vehicle is traveling up a grade, or is towing a load, the temperature of the oil 18 will increase to above that of the coolant 14, for example up to 110 degrees Celsius. The temperature of the oil 18 has a particular tendency to exceed the temperature of the coolant 14 in IC engines employing piston squirters. A piston squirter is a device used to spray oil at the underside of a piston that reciprocates inside a cylinder to generate a cooling effect during high load operation of some IC engines. When the temperature of the oil 18 has thus exceeded the temperature of the coolant 14, the second wax motor 44 of the actuator 38 will be activated by the controller 46. The activation of the second wax motor 44 will displace the valve 33 via the plunger 45. Such displacement of the valve 33 will expose the aperture 34 to the conduit 29 and permit the oil 18 to flow through the heat-exchanger 22 to be cooled to the temperature of the coolant 14, thus allowing the heat-exchanger to perform as an oil cooler.

Figure 7:
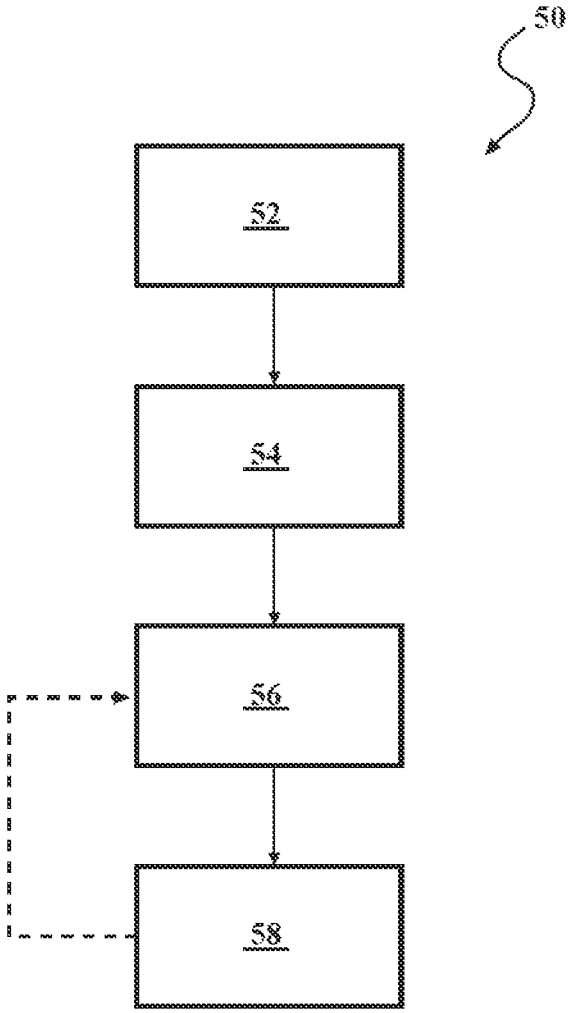
FIG. 7 schematically illustrates, in flow chart format, a method of controlling a temperature of oil of the power-plant shown in FIGS. 1-6.

FIG. 7 depicts a method 50 of controlling the temperature of oil 18 in the power-plant 12 shown in FIGS. 1-5. The method 50 is described with reference to FIGS. 1-5, and the above description of the system 10. The method commences at block 52, and then proceeds to frame 54. In frame 54, the method includes directing the oil 18 through a heat-exchanger 22 during the warm-up operation of the power-plant 12 such that the temperature of the oil is increased. The method then advances to frame 56. In frame 56, the method includes directing the oil 18 to bypass the heat-exchanger 22 during the low load operation of the power-plant 12 such that the temperature of the oil is increased. From frame 56 the method proceeds to frame 58, where it includes directing the oil 18 through the heat-exchanger 22 during the high load operation of the power-plant 12 such that the temperature of the oil is reduced. According to the method 50, following frame 58, the method may loop back to frame 56 and permit the oil to again bypass the heat-exchanger 22 when the power-plant 12 reverts to the low load operation.

While the best modes for carrying out the invention have been described in detail, those familiar with the art to which this invention relates will recognize various alternative designs and embodiments for practicing the invention within the scope of the appended claims.

The invention claimed is:

1. A system for controlling a temperature of oil in a power-plant that produces heat energy as a by-product of generating power and is operable to propel a vehicle, the system comprising:

a heat-exchanger arranged relative to the power-plant, wherein the heat-exchanger is configured to receive from the power-plant the oil and a coolant that removes the heat energy from the power-plant, modify the temperature of the oil via heat transfer between the oil and the coolant, and return the modified temperature oil to the power-plant; and a valve configured to:

direct the oil through the heat-exchanger during a warm-up operation of the power-plant when a temperature of the coolant is greater than the temperature of the oil such that the temperature of the oil is increased;

direct the oil to bypass the heat-exchanger during a low load operation of the power-plant such that the temperature of the oil is increased above the temperature of the coolant; and direct the oil through the heat-exchanger during a high load operation of the power-plant when the temperature of the oil is greater than the temperature of the coolant such that the temperature of the oil is decreased;

an actuator configured to operate the valve; and a controller in electrical communication with the actuator, wherein the controller is configured to regulate the valve via the actuator according to each of the warm-up, low load, and high load operation of the power-plant.

2. The system of claim 1, wherein the valve is additionally configured to direct the oil to bypass the heat-exchanger during a low ambient temperature start of the power-plant such that the temperature of the oil is not modified by the heat-exchanger when the temperature of the oil and the temperature of the coolant are each at ambient temperature below zero Celsius, and wherein the controller is additionally configured to regulate the valve via the actuator during the low ambient temperature start of the power-plant.

3. The system of claim 1, further comprising a spring configured to bias the valve against the actuator.

4. The system of claim 3, wherein the actuator is one of a wax motor and a solenoid.

5. The system of claim 4, wherein the wax motor is configured as a two-stage wax motor.

6. The system of claim 1, further comprising a fluid pump configured to circulate the coolant through the heat-exchanger to modify the temperature of the oil.

7. The system of claim 1, wherein the power-plant is an internal combustion engine.

8. A method of controlling a temperature of oil in a power-plant that produces heat energy as a by-product of generating power and is operable to propel a vehicle, the method comprising:

directing the oil, via a controller, during a warm-up operation of the power-plant through a heat-exchanger arranged relative to the power-plant when a temperature of a coolant of the power-plant is greater than the temperature of the oil such that the temperature of the oil is increased, wherein the heat-exchanger is configured to receive from the power-plant the oil and the coolant that removes the heat energy from the power-plant, modify the temperature of the oil via heat transfer between the oil and the coolant, and return the modified temperature oil to the power-plant;

directing the oil, via the controller, to bypass the heat-exchanger during a low load operation of the power-plant such that the temperature of the oil is increased above the temperature of the coolant; and directing the oil, via the controller, through the heat-exchanger during a high load operation of the power-plant when the temperature of the oil is greater than the temperature of the coolant such that the temperature of the oil is decreased.

9. The method of claim 8, further comprising directing the oil, via the controller, to bypass the heat-exchanger during a low ambient temperature start of the power-plant such that the temperature of the oil is not modified by the heat-exchanger when the temperature of the oil and the temperature of the coolant are each at ambient temperature below zero Celsius.

10. The method of claim 9, wherein said directing the oil during each of the low ambient temperature start, warm-up operation, the low load operation, and the high load operation of the power-plant is accomplished via a valve.

11. The method of claim 10, further comprising operating the valve via an actuator and regulating the actuator via the controller.

12. The method of claim 11, further comprising biasing the valve against the actuator via a spring.

13. The method of claim 12, wherein the actuator is one of a wax motor and a solenoid.

14. The method of claim 13, wherein the wax motor is configured as a two-stage wax motor.

15. The method of claim 8, further comprising circulating the coolant through the heat-exchanger via a fluid pump to modify the temperature of the oil.

16. The method of claim 8, wherein the power-plant is an internal combustion engine.

17. A system for controlling a temperature of oil in a power-plant that produces heat energy as a by-product of generating power and is operable to propel a vehicle, the system comprising:

a heat-exchanger arranged relative to the power-plant, wherein the heat-exchanger is configured to receive from the power-plant the oil and a coolant that removes the heat energy from the power-plant, modify the temperature of the oil via heat transfer between the oil and the coolant, and return the modified temperature oil to the power-plant;

a valve configured to:

direct the oil through the heat-exchanger during a warm-up operation of the power-plant when a temperature of the coolant is greater than the temperature of the oil such that the temperature of the oil is increased;

direct the oil to bypass the heat-exchanger during a low load operation of the power-plant such that the temperature of the oil is increased above the temperature of the coolant; and direct the oil through the heat-exchanger during a high load operation of the power-plant when the temperature of the oil is greater than the temperature of the coolant such that the temperature of the oil is decreased;

direct the oil to bypass the heat-exchanger during a low ambient temperature start of the power-plant such that the temperature of the oil is not modified by the heat-exchanger when the temperature of the oil and the temperature of the coolant are each at ambient temperature below zero Celsius;

an actuator configured to operate the valve;

a controller in electrical communication with the actuator, wherein the controller is configured to regulate the valve via the actuator according to each of the warm-up, low load, and high load operation of the power-plant, and during the low ambient temperature start of the power-plant;

a two-stage wax motor configured to operate the valve; and a spring configured to bias the valve against the two-stage wax motor.

* * * * *